US009878431B2

(12) United States Patent
Herr et al.

(10) Patent No.: US 9,878,431 B2
(45) **Date of Patent: *Jan. 30, 2018**

(54) TACTICAL ENTRY TOOL

(71) Applicant: J&N TACTICAL, LLC, South Haven, MN (US)

(72) Inventors: Jeffrey Herr, South Haven, MN (US); Matt Herr, West Des Moines, IA (US)

(73) Assignee: J&N TACTICAL, LLC, South Haven, MN (US)

( * ) Notice: Subject to any disclaimer, the term of this patent is extended or adjusted under 35 U.S.C. 154(b) by 823 days.

This patent is subject to a terminal disclaimer.

(21) Appl. No.: 13/759,345

(22) Filed: Feb. 5, 2013

(65) Prior Publication Data

US 2013/0145904 A1 Jun. 13, 2013

Related U.S. Application Data

(63) Continuation of application No. 12/957,917, filed on Dec. 1, 2010, now Pat. No. 8,387,487.

(51) Int. Cl.

| | |
|---|---|
| ***B25D 1/14*** | (2006.01) |
| ***A62B 3/00*** | (2006.01) |
| *B25D 1/02* | (2006.01) |

(52) U.S. Cl.

CPC ..... *B25D 1/14* (2013.01); *A62B 3/005* (2013.01); *B25D 1/02* (2013.01)

(58) Field of Classification Search

CPC ... B25D 1/14; B25D 1/00; B25D 1/04; B25D 1/02; A62B 3/005; B25F 1/00

USPC .... 81/20, 25–27, 463; 254/21, 25, 28, 26 R, 254/26 E; 173/90–92

See application file for complete search history.

(56) References Cited

U.S. PATENT DOCUMENTS

| | | | | | |
|---|---|---|---|---|---|
| 633,465 | A | * | 9/1899 | Mertes | 172/349 |
| 1,043,459 | A | | 11/1912 | Perry | |
| 2,857,835 | A | | 10/1958 | Fitzgerald | |
| 3,514,854 | A | * | 6/1970 | Norfleet | 30/292 |
| 4,072,197 | A | * | 2/1978 | Boyd-Dunlop | 172/349 |
| 4,274,202 | A | * | 6/1981 | Petrick | 30/365 |
| 4,502,223 | A | | 3/1985 | Brookfield | |
| 5,067,237 | A | | 11/1991 | Holder | |
| 5,088,174 | A | | 2/1992 | Hull et al. | |

(Continued)

OTHER PUBLICATIONS

Tactical Entry Tools listed in 2009 Catalog, Blackhawk Products Group, p. 223-235.

(Continued)

*Primary Examiner* — Larry E Waggle, Jr.
*Assistant Examiner* — Danny Hong
(74) *Attorney, Agent, or Firm* — Hamre, Schumann, Mueller and Larson, P.C.

(57) ABSTRACT

A tactical entry tool for creating an entry point through a building structure is provided. The tool includes a shaft portion including a shaft, and a head portion attached to a first end of the shaft. The head portion includes two heads, with each head including a head shaft extending from the shaft to form a 'Y' shaped structure and a break head portion attached to the head shaft at an opposite end from which the head shaft is connected to the shaft. Each break head portion includes a plurality of teeth surrounding the perimeter of the break head portion and a plurality of breaker tips extending from the break head portion.

23 Claims, 9 Drawing Sheets

(56) References Cited

U.S. PATENT DOCUMENTS

| | | | | |
|---|---|---|---|---|
| 5,497,556 | A * | 3/1996 | Lebessis | 30/365 |
| 5,588,343 | A * | 12/1996 | Rust et al. | 81/489 |
| 5,643,403 | A * | 7/1997 | Poole | 156/762 |
| 5,810,333 | A | 9/1998 | Hickerson et al. | |
| 5,987,723 | A | 11/1999 | McNally et al. | |
| 6,272,900 | B1 | 8/2001 | Kobel | |
| 6,276,085 | B1 | 8/2001 | Wooten et al. | |
| 6,318,228 | B1 | 11/2001 | Thompson | |
| 8,387,487 | B2 * | 3/2013 | Herr et al. | 81/26 |
| 2006/0170231 | A1 * | 8/2006 | Brown et al. | 294/60 |
| 2006/0260829 | A1 | 11/2006 | Kleinert | |
| 2008/0149358 | A1 | 6/2008 | Catlin | |

OTHER PUBLICATIONS

Break and Rake Tools listed in 2010 Catalog, J&N Tactical, p. 1, 4, 6, 8, 9, 11, 17-27, 29-32, 36, 41 (23 pages).

James A. Larson, Statement Regarding J&B Tactical 2010 Catalog, Apr. 20, 2012 (1 page).

"S.E.T. Tools Ultra Force Break and Rake Tool," available at http://www.drillspot.com/products/1436263/SET_Tools_BRB-50AH-D_Ultra_Force_Break_and_Rake_Tool, accessed Nov. 16, 2011 (1 page).

"Jersey Tactical Corp.: The Jersey Boot, Multi-Purpose Breaching/Rescue Tool," available at http://www.thefirestore.com/store/product.cfm?pID=6996, accessed Nov. 16, 2011 (2 pages).

"Rapid Assault Tools—Pry Bars," available at http://ratools.com/rat_et_pry-bars.html, accessed Nov. 16, 2011 (1 page).

"L.N. Curtis & Sons: Breaching Equipment & Tools," available at http://www.lncurtis.com/onlineshop-breaching_equipment_tools, accessed Nov. 16, 2011 (1 page).

"T3 Trident Tactical Technical: Gransfors Breaching Tools," available at http://t3gear.com/gransfors.aspx, accessed Nov. 16, 2011 (1 page).

"Cutting Edge Tactical: Fire & Rescue Equipment and Breaching Tools: Paratech," available at http://www.cuttingedgetactical.com/paratech.aspx, accessed Nov. 16, 2011 (3 pages).

"BCM Inc. Double-Tap Breaching Tools," available at http://www.breachingtools.com/Breaching%20Tools.html, accessed Nov. 16, 2011 (2 pages).

"ZAK Tool Halligan Entry Tools," available at http://www.zaktool.com/halligan-f.html, accessed Nov. 16, 2011 (1 page).

"ZAK Tool Tactical Entry Tools," available at http://www.zaktool.com/tactical.html, accessed Nov. 16, 2011 (3 pages).

"Council Tool: KATool, Kwik Access Tool," available at http://www.thefirestore.com/store/product.cfm?pID=4457, accessed Nov. 16, 2011 (1 page).

"Wedge and Pry Tools," available at http://www.thefirestore.com/store/catagory.cfm/cid_2058_wedge_pry_tools/, accessed Nov. 16, 2011 (1 page).

"Safe Search Tools: The ASSET Kit," available at http://www.safesearchtools.com/Products.html, accessed Nov. 16, 2011 (1 page).

"Forced Entry Tactical Training Collapsable Rakes," available at http://forcedentrytacticaltraining.com/forced-entry-tools/index.php?cPath=22_58_66, accessed Nov. 16, 2011 (1 page).

"Forced Entry Tactical Training Collapsable Entry Tools," available at http://forcedentrytacticaltraining.com/forced-entry-tools/index.php?cPath=22_58, accessed Nov. 16, 2011 (1 page).

"Gränsfors Breaching Tools: Break & Rake," available at http://entrytools.se/tools/break-rake.aspx, accessed Nov. 16, 2011 (1 page).

"Blackhawk UK Hallagan Tool," available at http://www.opticsplanet.net/blackhawk-uk-hallagan-tool.html, accessed Nov. 16, 2011 (1 page).

"Breaching Technologies Inc. Crook Hook Tool," available at http://www.breachingtechnologiesinc.com/tool-crook-hook.php, accessed Nov. 16, 2011 (1 page).

"Breaching Technologies Inc. Halligan Tool," available at http://www.breachingtechnologiesinc.com/tool_halligan.php, accessed Nov. 16, 2011 (1 page).

"Breaching Technologies Inc. Break and Rake Tool," available at http://www.breachingtechnologiesinc.com/tool_break_n_rake.php, accessed Nov. 16, 2011 (1 page).

"B-Safe Industries: Break and Rake Hooks," http://www.swatools.com/ecom/category/11/, accessed Nov. 16, 2011 (1 page).

"Blackhawk Break-N-Rake Entry Tool," available at http://www.lapolicegear.com/blbrento.html, accessed Nov. 16, 2011 (1 page).

"Blackhawk Tool Break-N-Rake Window Entry Tool," available at http://www.chiefsupply.com/4210-BLACKHAWK-Tool-Break-N-Rake-Window-Entry-Tool.aspx, accessed Nov. 16, 2011 (1 page).

* cited by examiner

TACTICAL ENTRY TOOL

FIELD

This disclosure relates to the field of tactical breaching equipment. More particularly, this description relates to a tactical entry tool.

BACKGROUND

For military and law enforcement special operations personnel, it is often necessary to quickly and efficiently create an entry or an observation opening in a building structure. Typical entry tools require that the operator stand directly in front of the window, wall or door of the building structure in order to create a primary or secondary entry point or an opening for observation. However, requiring the operator to stand directly in front of the entry/observation target of the building structure can expose the operator to enemy combatants and criminals attempting to prevent the operator from creating the entry point/observation opening.

SUMMARY

This application describes a tactical entry tool. Particularly, the embodiments described herein are directed to a tactical entry tool that allows an operator to quickly, efficiently, and safely create an entry point or observation opening through a building structure, particularly windows.

The embodiments described herein use at least a two break head configuration that allows the operator to clear out additional debris, such as glass, upon the initial breach of the entry/observation target. Also, the embodiments herein allow the operator to stand off to the side of the entry/observation target and use a chopping action on the entry/observation target with the tool to create the entry point/observation opening. Thus, the operator does not have to stand directly in front of the entry/observation target in order to create the entry point/observation opening. This allows the operator to quickly and efficiently create the entry point/observation opening without exposing the operator to enemy combatants or criminals attempting to prevent the operator from creating the entry point/observation opening. Further, the embodiments herein allow the operator perform a port and cover maneuver. For example, the operator uses the tactical entry tool to port a window in a building and then use a weapon, such as a firearm, to secure a suspect(s) and/or room until an entry team is able to enter the room.

In some embodiments, the tactical entry tool provided herein includes two break head portions with breaker tips that allow the operator to punch out, for example, top and bottom sliding windows on school and commuter buses, with one punch of the tool. The break head portions also include teeth that allow the operator to pull fabric, window blinds, or any other obscuring material from the window opening.

In some embodiments, the tactical entry tool includes a hammer plate located where the two heads are attached to the shaft portion. The hammer plate allows the operator to pound out both vertical and horizontal structures, such as window support structures.

In some embodiments, the tactical entry tool includes rake fins attached to the shaft of the tactical entry tool near the head portion. The rake fins allow the operator to remove stubborn pieces of debris, such as, for example, glass captured by window moldings, etc.

In one embodiment, a tactical entry tool for creating an entry point through a building structure is provided. The tool includes a shaft portion comprising a shaft, and a head portion attached to a first end of the shaft. The head portion includes two heads, with each head comprising a head shaft extending from the shaft to form a 'Y' shaped structure and a break head portion attached to the head shaft at an opposite end from which the head shaft is connected to the shaft. Each break head portion includes a plurality of teeth surrounding the perimeter of the break head portion and a plurality of breaker tips extending from the break head portion.

In another embodiment, a head component for a tactical entry tool is provided. The head component includes two heads, with each head including a head shaft attached a hammer plate near a first end of the hammer shaft, and a break head portion attached to the head shaft at a second end of the head shaft opposite the first end of the hammer shaft. The hammer plate includes a middle portion and two side portions, with each side portion extending away from opposite sides of the middle portion at an angle towards one of the break head portions. Each break head portion includes a plurality of teeth surrounding a perimeter of the break head portion and a plurality of breaker tips extending from the break head portion.

In yet another embodiment, a break head portion for a tactical entry tool is provided. The break head portion includes a middle plate and a plurality of peripheral plates. Each of the peripheral plates is attached to a side of the middle plate and to a side of adjacent peripheral plates. The break head portion also includes a plurality of breaker tips extending out from the middle plate and the plurality of peripheral plates. Each of the peripheral plates extends away from the middle plate at an angle towards a back face of the middle plate. Also, a side of each of the peripheral plates opposite the side of the peripheral plate attached to the middle plate is formed with a plurality of teeth

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice what is claimed, and it is to be understood that other embodiments may be utilized without departing from the spirit and scope of the claims. The following detailed description is, therefore, not to be taken in a limiting sense.

The embodiments described herein are directed to a tactical entry tool that allows an operator to quickly, efficiently, and safely create an entry point/observation opening through a building structure, particularly windows. Particularly, the embodiments described herein allow the operator to stand off to the side of the entry/observation target and use a chopping action on the entry/observation target with the tool 100 to create the entry point/observation opening. Thus, the operator does not have to stand directly in front of the entry/observation target in order to create the entry point/observation opening. This allows the operator to quickly and efficiently create the entry point/observation opening without exposing the operator to enemy combatants or criminals attempting to prevent the operator from creating the entry point/observation opening. The tool 100 also allows the operator to safely and effectively perform a port and cover maneuver.

FIGS. 1-8 illustrate one embodiment of a tactical entry tool 100. The tactical entry tool 100 includes a head portion 105, a shaft portion 110 and a handle portion 115. In the embodiment shown in FIGS. 1 and 2, the entire length of the tactical entry tool 100 can be, for example, five feet. However, in other embodiments, the tool 100 can be any length desired by the operator, typically between three to eight feet. Also, the weight of the tool 100 is preferably between, for example, 11-15 lbs., however the weight of the tool 100 can be modified as desired by the user. Preferably, the weight is distributed toward the head portion 105 to create a greater impact force when the tool is swung at an entry/observation target.

Further, the tool 100 is, for example, made entirely of steel such as cold rolled steel. However, in other embodiments the tool 100 can be constructed with other types of materials, such as titanium or aluminum.

Figure 1:
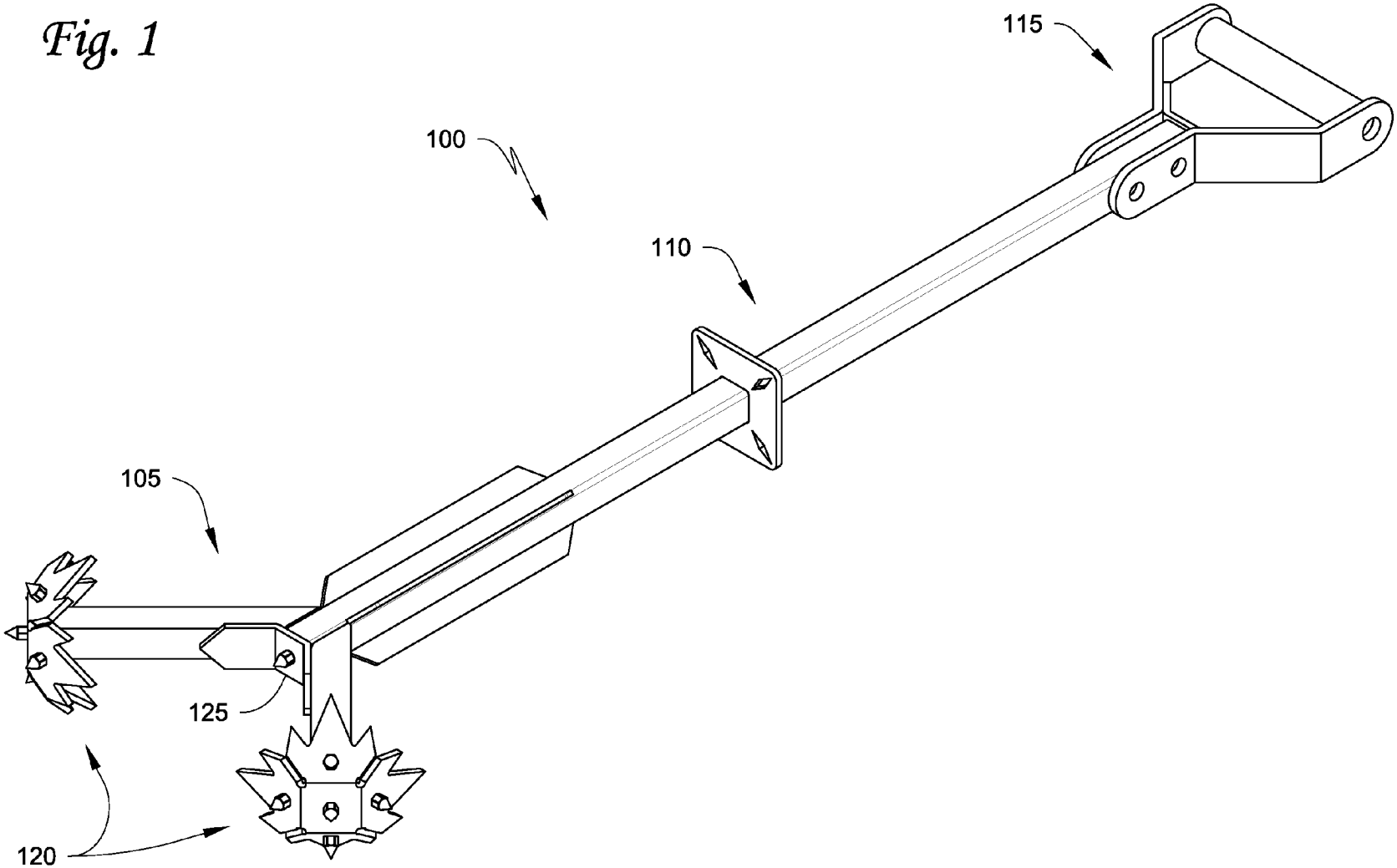
FIG. 1 is a front perspective view of a tactical entry tool according to one embodiment.
Figure 2:
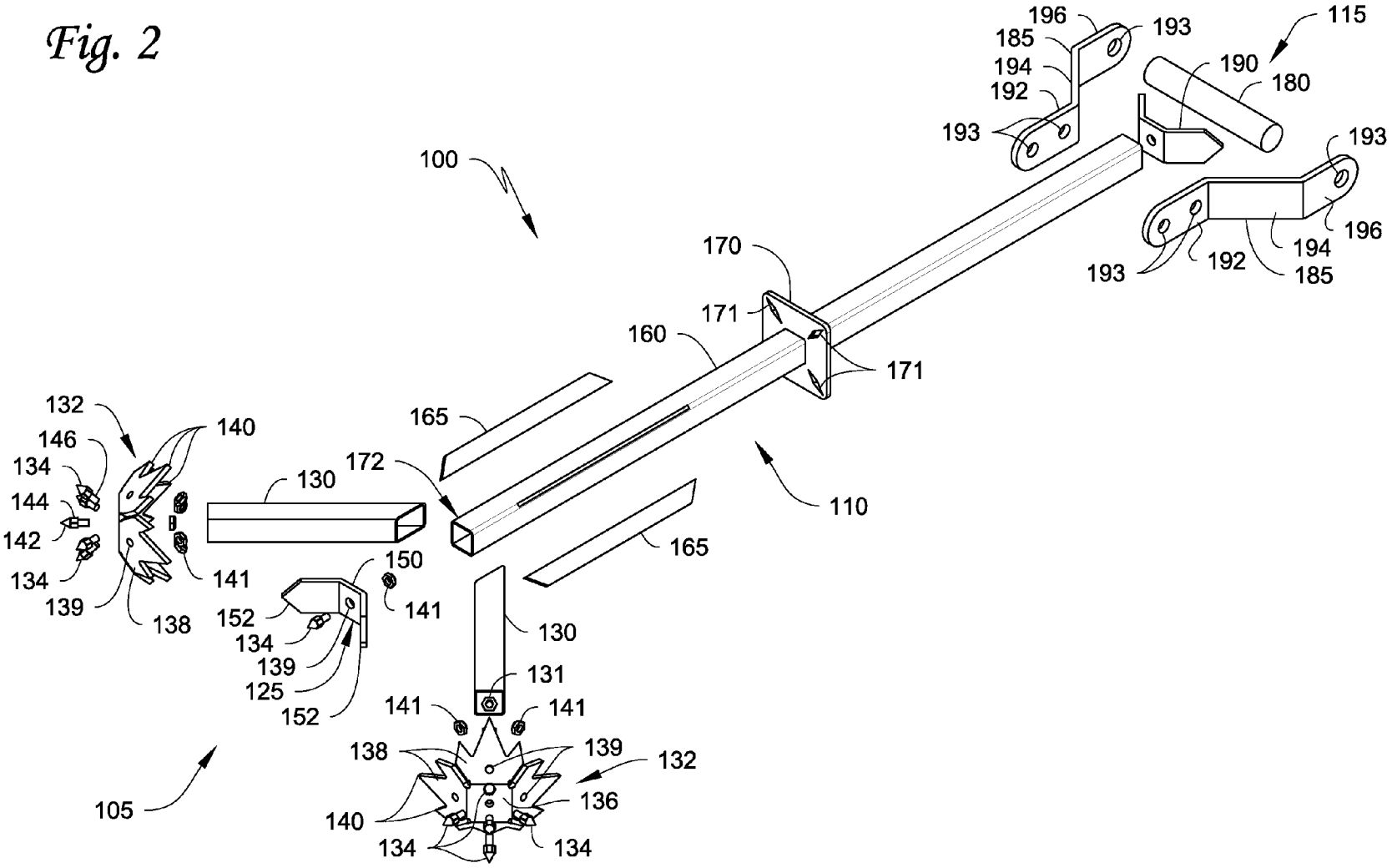
FIG. 2 is an exploded perspective view of the tactical entry tool shown in FIG. 1.
Figure 3:
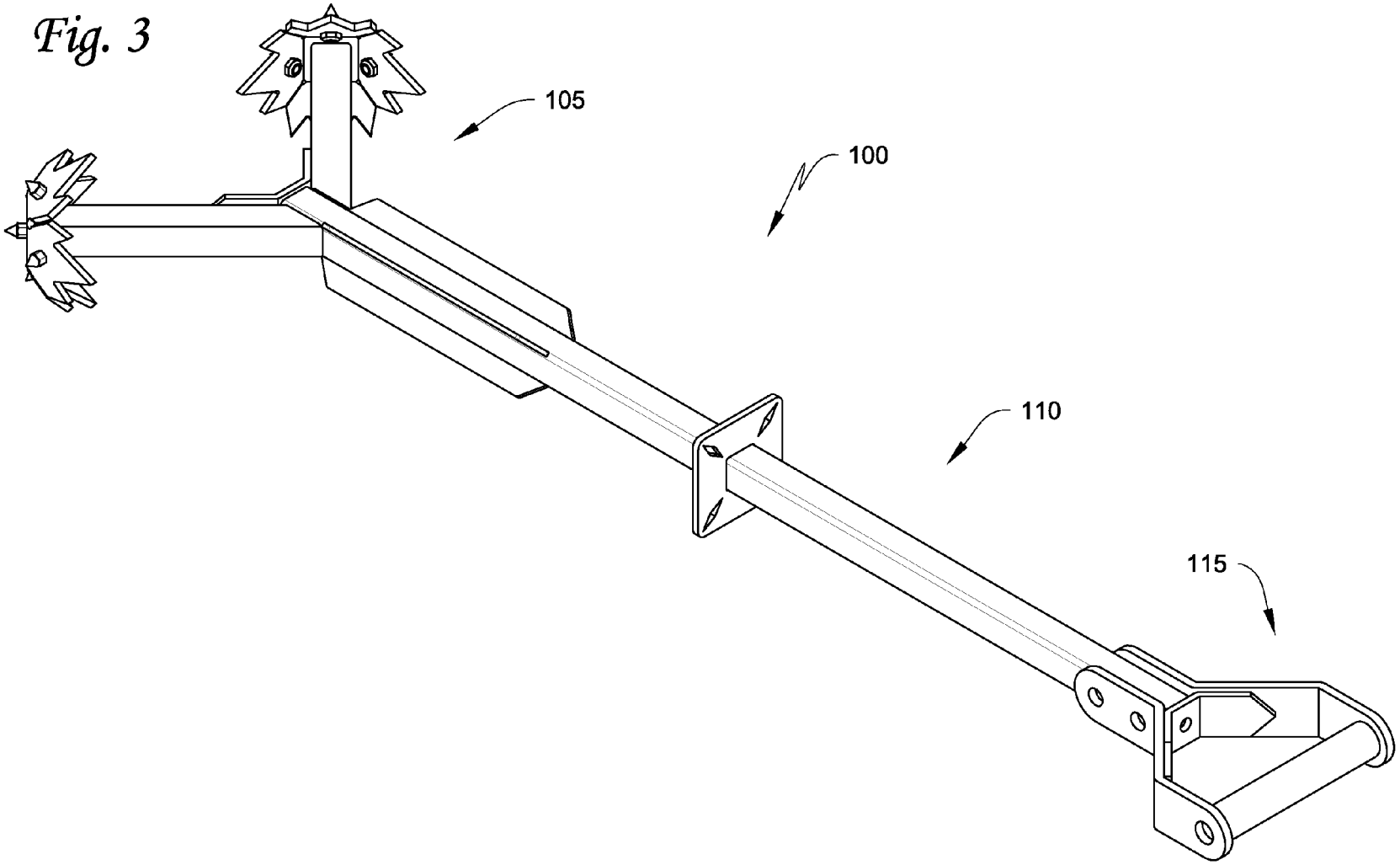
FIG. 3 is a rear perspective view of the tactical entry tool shown in FIG. 1.
Figure 4:
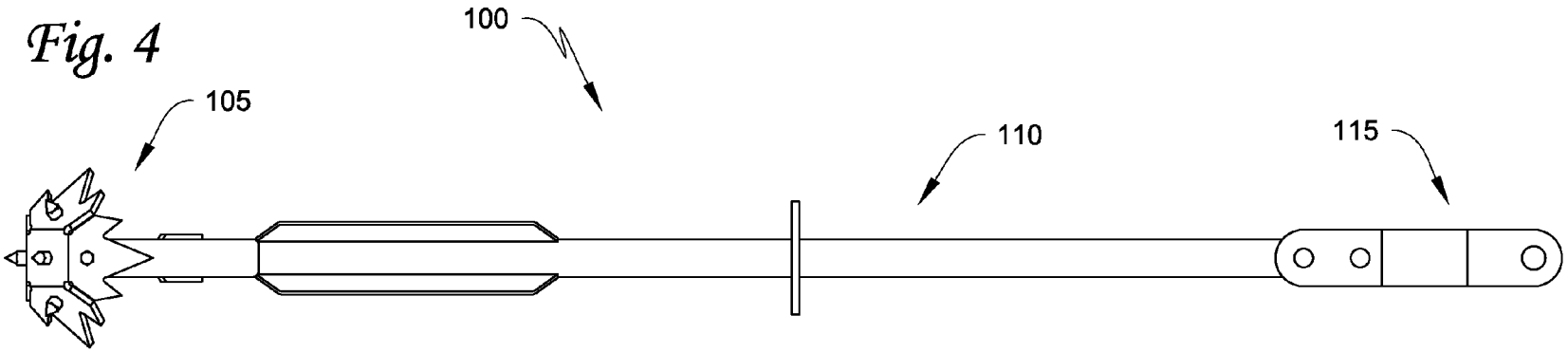
FIG. 4 is a side view of the tactical entry tool shown in FIG. 1.
Figure 5:
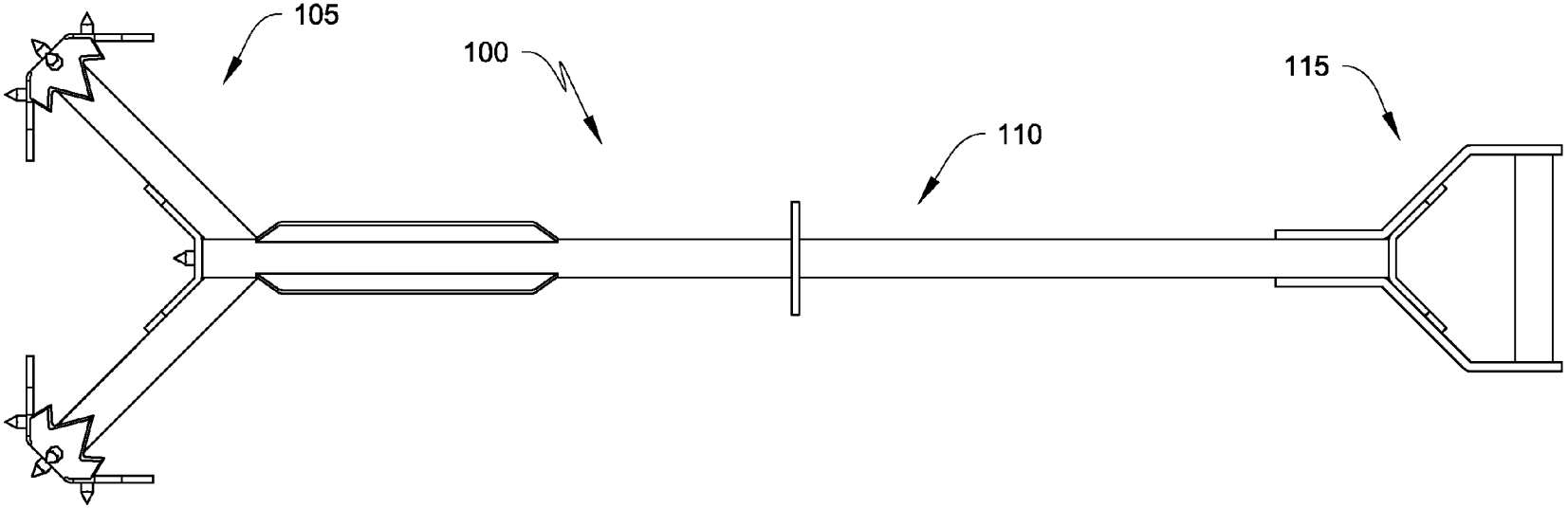
FIG. 5 is a top or bottom view of the tactical entry tool shown in FIG. 1.
Figure 6:
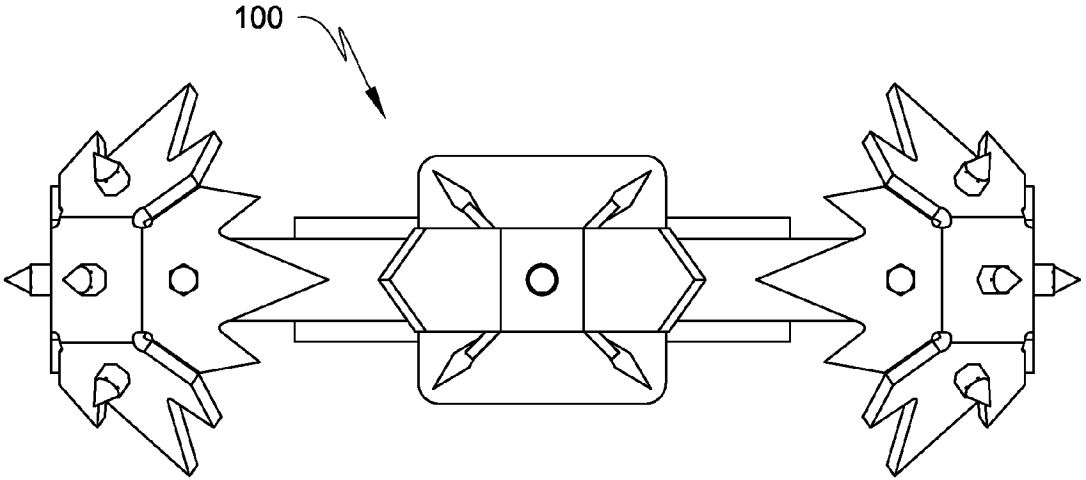
FIG. 6 is a front end view of the tactical entry tool shown in FIG. 1.
Figure 7:
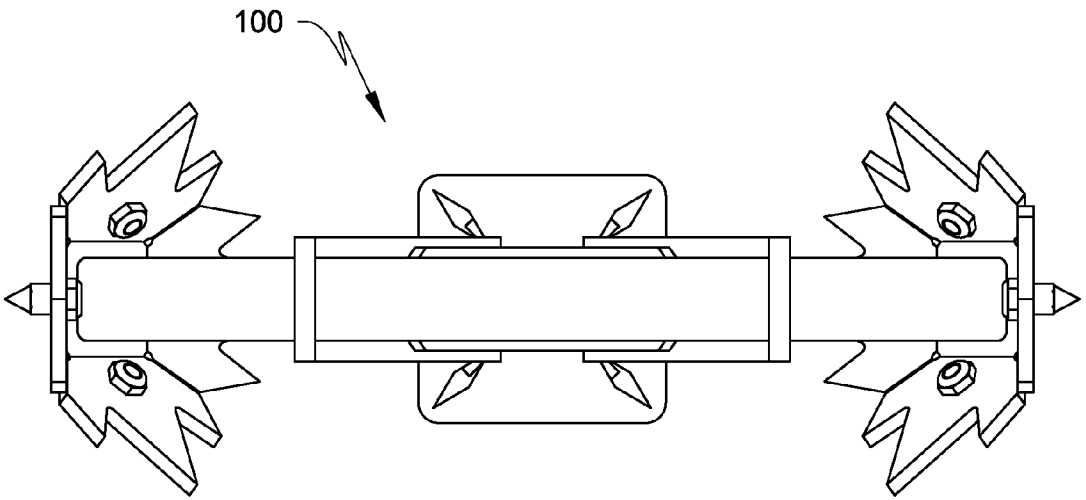
FIG. 7 is a rear end view of the tactical entry tool shown in FIG. 1.

Reference is first made to the head portion 105. The tactical entry tool 100 shown in FIGS. 1 and 2 is a two-headed tool. That is, the head portion 105 includes two heads 120. The head portion 105 also includes a hammer plate 125 between the two heads 120. In the embodiment shown in FIGS. 1 and 2, both of the heads 120 are identical. While the tactical entry tool 100 shown in FIGS. 1 and 2 includes two heads 120, in some embodiments, the tactical entry tool 100 can include more than two heads. Also in some embodiments, the tactical entry tool 100 does not include a handle portion 115, but includes two head portions (such as the head portion 105) with one head portion on either end of the handle portion 110 (not shown).

Each of the heads 120 includes a head shaft 130 extending from the shaft portion 110, a break head portion 132 and a plurality of breaker tips 134. Preferably, the head shafts 130 extend from the shaft portion 110 to form a 'Y' shaped structure. For example, in the embodiment shown in FIGS. 1 and 2, both of the head shafts 130 extend from the shaft portion 110 at an approximately 45° angle. In other embodiments, the head shafts 130 can extend from the shaft portion 110 at an angle anywhere between approximately 22.5° and 130°. In this embodiment, the length of each head shaft 130 can be, for example, approximately 7.5 inches. However, in other embodiments, the length of each head shaft 130 can vary based on the needs of the operator. In some embodiments the head shafts 130 are welded to the shaft portion 110.

The break head portions 132 are formed at respective ends of the head shafts 130 away from the shaft portion 110. As shown in FIG. 2, a bushing 131 is formed at an end of each of the head shafts 130. In some embodiments, the head shafts 130 are welded to the break head portions 132. In other embodiments, the head shafts 130 are bolted to the break head portions 132. In yet some other embodiments, the head shafts 130 are welded and bolted to the break head portions 132.

Each of the break head portions 132 include a middle plate 136 surrounded by four peripheral plates 138. Each of the peripheral plates 138 extend back at approximately a 30° angle toward the head shaft 130, which provides a large surface area when the break head portions 132 make contact with the entry target. As shown in FIG. 2, the approximate center of the middle plate 136 and the approximate center of the peripheral plates 138 each include an opening 139 for attaching the breaker tips 134.

Each of the peripheral plates 138 includes teeth 140 at a side furthest away from the middle plate 136. In the embodiment shown in FIG. 1, each of the peripheral plates 138 includes four equally spaced and sized teeth 140. In other embodiments, the number of teeth 140 on each peripheral plate 138 can vary and the size and spacing of each of the teeth 140 in each of the peripheral plates 138 can also vary. For example, in another embodiment, each of the peripheral plates 138 includes two equally sized teeth on either side of a larger tooth (not shown). The teeth 140 allow the tool 100 to rip, tangle and remove obstructions such a curtains, blinds etc. at the entry/observation target. The operator can remove obstructions, for example, by using a punch, twist and pull action with the tool 100.

Each of the breaker tips 134 includes a cone portion 142 with the tip end of the cone portion 142 extending away from the tool 100, a base portion 144 contacting an outside surface of the respective middle plate 136 or the peripheral plate 138, and a connecting portion 146 that fits into the opening 139 of the respective middle plate 136 or the peripheral plate 138. The breaker tips 134 are then held in place by bushings 141 on the connecting portions 146 on the other side of the opening 139. The breaker tips 134 allow the tool 100 to break into entry/observation targets, particularly windows. In the embodiment shown in FIGS. 1 and 2, the breaker tips 134 are made of steel.

The head portion 105 also includes the hammer plate 125 attached to the shaft portion 110 and the two head shafts 130. The hammer plate 125 includes a middle portion 150 that is attached to the shaft portion 110, and two side portions 152 attached to the respective head shafts 130 of the two heads 120 and extend away from the middle portion 150 at approximately a 45° angle, similar to how the two head shafts 130 extend away from the shaft portion 110. An opening 139 is formed at an approximate center of the middle portion 150 attaching an additional breaker tip 134 using the bushing 141. In some embodiments, the hammer plate 125 is formed without the opening 139 and does not have a breaker tip 134 attached to the middle portion 150. In some embodiments the hammer plate 125 is welded to the shaft portion 110 and the two head shafts 130. The hammer plate 125 can be used for breaking a middle frame structure between two panes of glass that make up a window.

In some embodiments, the head portion 105 is not permanently attached to the shaft portion 110 and can be replaced with another head portion. Thus, if portions of the head portion 105 become worn or break after repeated use of the tool 100, or if the operator desires a head portion that has, for example, different size measurements, the operator can then replace the head portion of the tool 100.

Reference now is made to the shaft portion 110. The shaft portion 110 includes a shaft 160 and rake fins 165. The shaft portion 110 also includes a shield plate 170. However, in some embodiments, the tactical entry tool described herein does not include a shield plate. In the embodiment shown in FIGS. 1 and 2, the shaft 160 has a square shaped cross section. However, in other embodiments, the cross section of the shaft 160 can have another shape such as, for example, a circular shape. Also, the length of the shaft 160 in the embodiment shown in FIGS. 1 and 2 can be, for example, approximately four feet. Further, the shaft 160 has a hollow interior. However, in other embodiments the shaft 160 is not hollow.

The rake fins 165 are located near a first end 172 of the shaft 160 that is towards the head portion 105 of the tool 100. While FIGS. 1 and 2 include four rake fins 165, in other embodiments the number of rake fins can be increased or decreased as desired. The rake fins 165 are trapezoid shaped with a long side of the rake fins 165 attached to the shaft 160 and, for example, approximately 8 inches in length, and a short side of the rake fins 165 away from shaft 160 and, for example, approximately 7.375 inches in length. The width of each of the rake fins 165 can be, for example, approximately 0.125 inches. In some embodiments, the rake fins 165 are welded to the shaft 160. Also, in some embodiments two rake fins are attached to each other by a middle plate (not shown) that is then attached to the shaft 160. In this configuration, four rake fins are attached to the shaft 160 by attaching two middle plates (with a pair of rake fins extending from each middle plate) to opposite sides of the shaft 160 (not shown).

Once an opening is made by the head portion 105 of the tool 100, the rake fins 165 allow the operator to break and remove additional shards of the obstruction that may have remained. For example, when the entry/observation target is a window, the head portion 105 breaks the glass initially, and the rake fins 165 can then be used to remove any remaining shards of glass that were not removed by the head portion 105.

The shield plate 170 is located near the middle of the shaft 160 and includes an opening that is shaped to allow the shaft 160 to pass there through. The shape of the illustrated shield plate 170 is a square shape. However, in other embodiments, the shield plate can have a different shape such as, for example, a circle. Each of the four sides of the shield plate 170 is for example, approximately 3 inches in length. In some embodiments, the shield plate 170 is welded to the shaft 160. The shield plate 170 acts as a shield to protect the hand of the operator that holds the shaft 160 from debris when the tool 100 is used to create an entry point.

Reference is now made to the handle portion 115. The handle portion 115 includes a handle 180, two handle supports 185, and a handle brace 190. The handle 180 is preferably cylindrically shaped to allow the hand of the operator have a firm and comfortable grip when handling the tool 100. However, in other embodiments the shape of the handle 180 can be another shape that provides the operator a firm grip of the tool 100. Also, in some embodiments, portions of the handle portion 115, such as the handle 180, is coated with a poly resin to provide a firm grip for the operator.

Each of the handle supports 185 include a first handle end 192 attached to the shaft 160, a middle handle portion 194 extending away from the shaft 160 at an approximately 45° angle, and a second handle end 196 extending away from the shaft 160 along a plane parallel to the shaft 160 and attached to an end of the handle 180. As shown in FIGS. 1 and 2, the first handle end 192 includes two apertures 193 and the second handle end 196 includes a single aperture 193.

The apertures 193 allow the handle supports 120 to be plug welded the shaft 160 and the handle 180. The handle brace 190 is also attached to the middle handle portions 194 and is configured to provide further support for the handle portion 115. In some embodiments, the first handle ends 192 are plug welded to the shaft 160, the second handle ends 196 are plug welded to the handle 180, and the handle brace 190 is welded to both the middle handle portions 194.

In operation, the operator preferably uses one hand to grip the handle portion 115 and one hand to hold the shaft portion 110 behind the shield plate 170. The operator can then use a chopping motion to create an opening in an obstacle without having to stand directly in front of the entry/observation target. Once the head portion 105 creates an opening in the obstacle, the operator can then use the hammer plate 125 and the rake fins 165 to break through and remove additional debris in the entry/observation target to provide a safe entry point in the obstacle.

In some embodiments, the tool includes a sling mount (not shown). For example, in one embodiment, a sling mount that includes a strap with a carabiner attached to each end can be used with one carabiner attached to one of holes 171 formed in the shield plate 170 and the other carabiner attached to an sling mount attachment (not shown) that is attached, such as by welding, to the middle handle portion 194. While the holes 171 shown in FIG. 2 are diamond shaped, in other embodiments the holes 171 can have another shape including, for example, a square shape.

Figure 8:
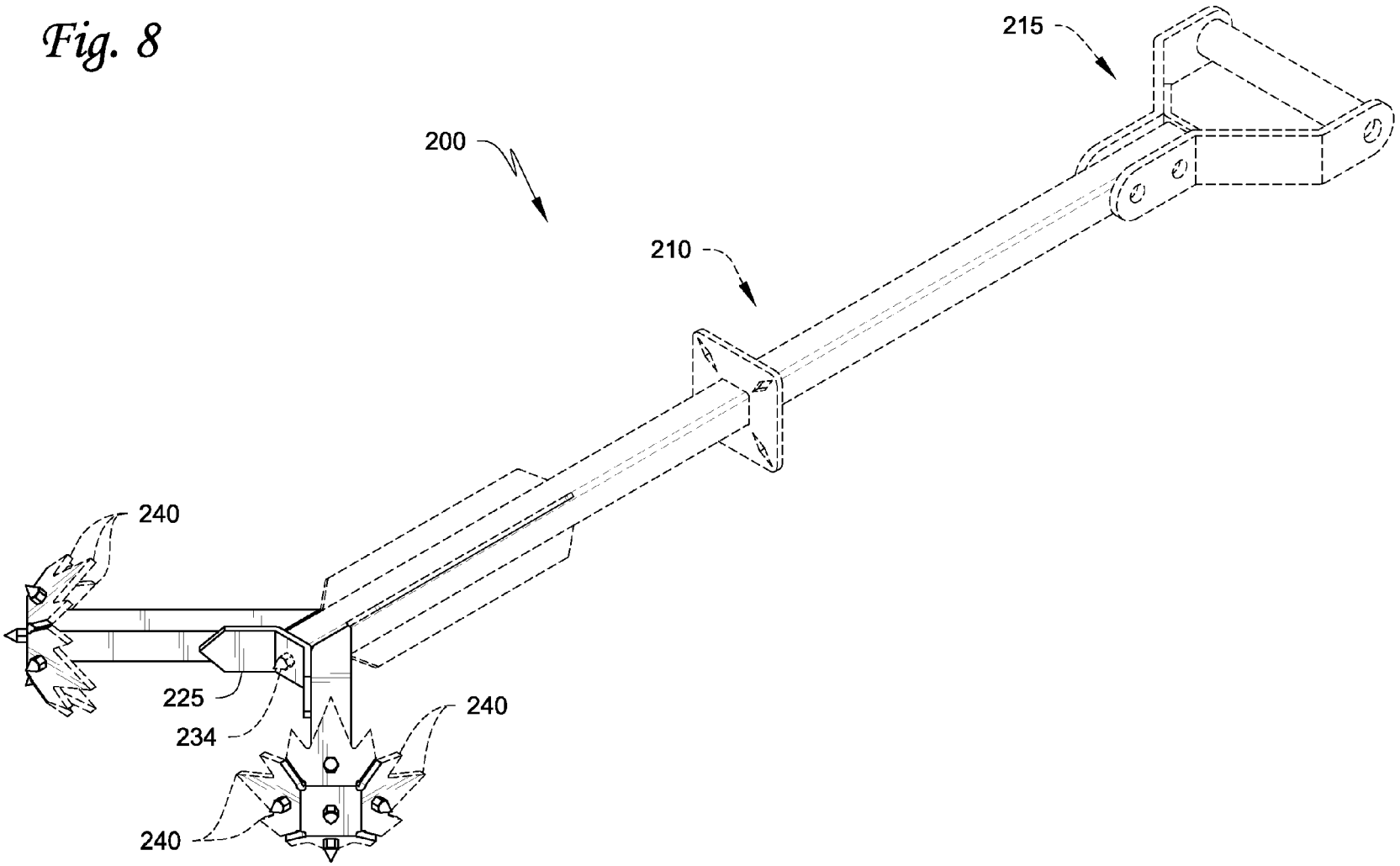
FIG. 8 is a front perspective view of another embodiment of a tactical entry tool.
Figure 9:
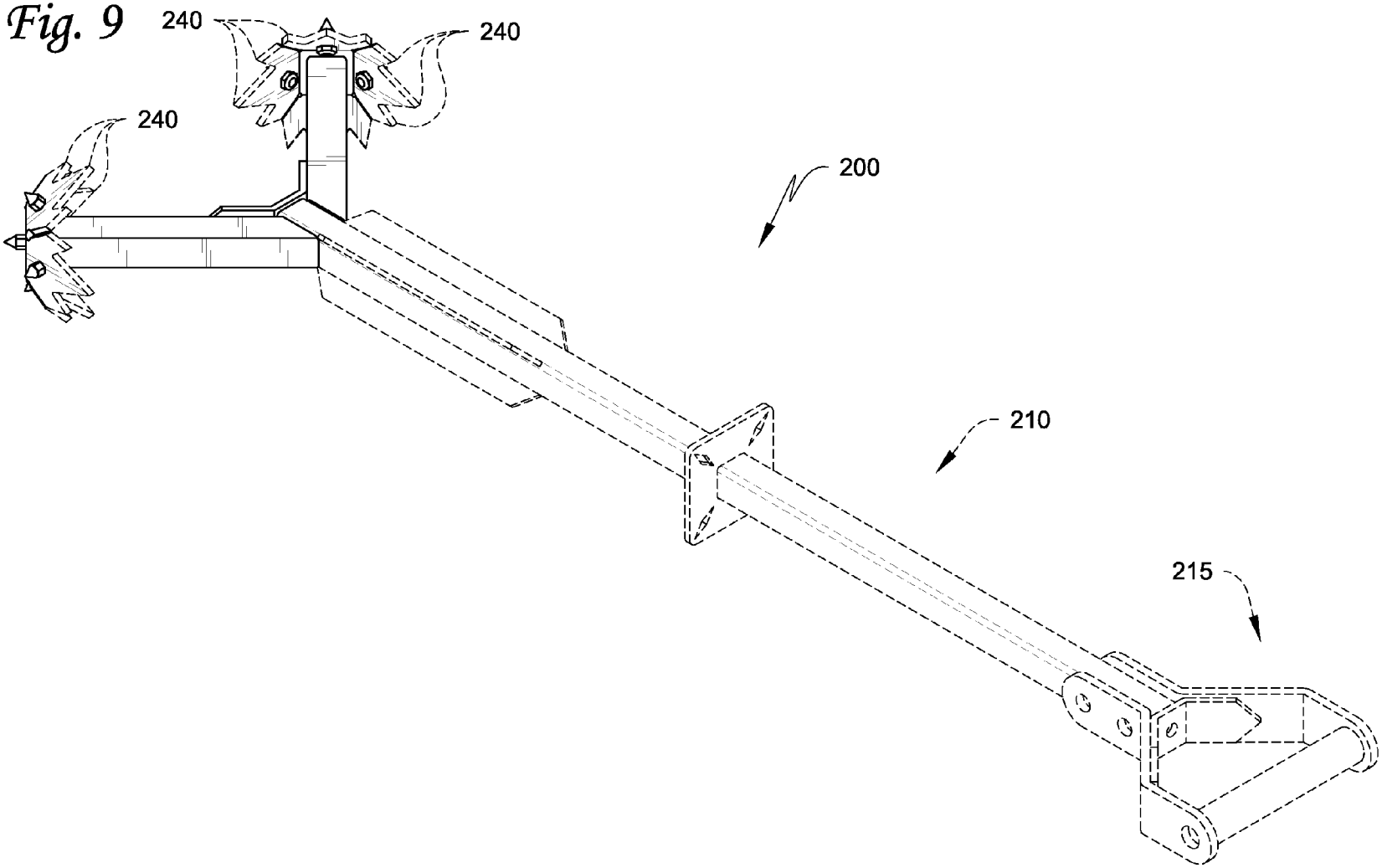
FIG. 9 is a rear perspective view of the tactical entry tool shown in FIG. 8.
Figure 10:
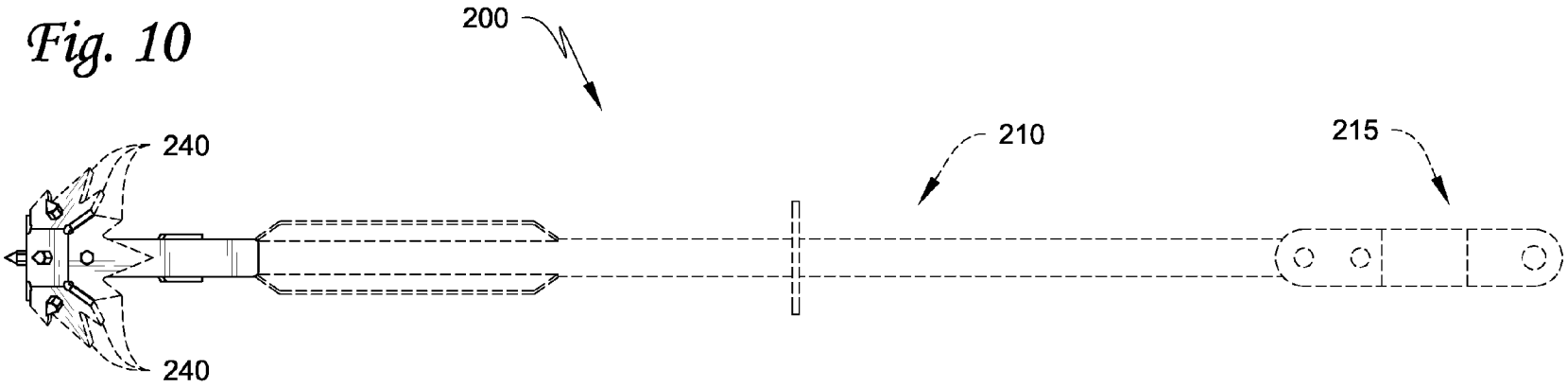
FIG. 10 is a side view of the tactical entry tool shown in FIG. 8.
Figure 11:
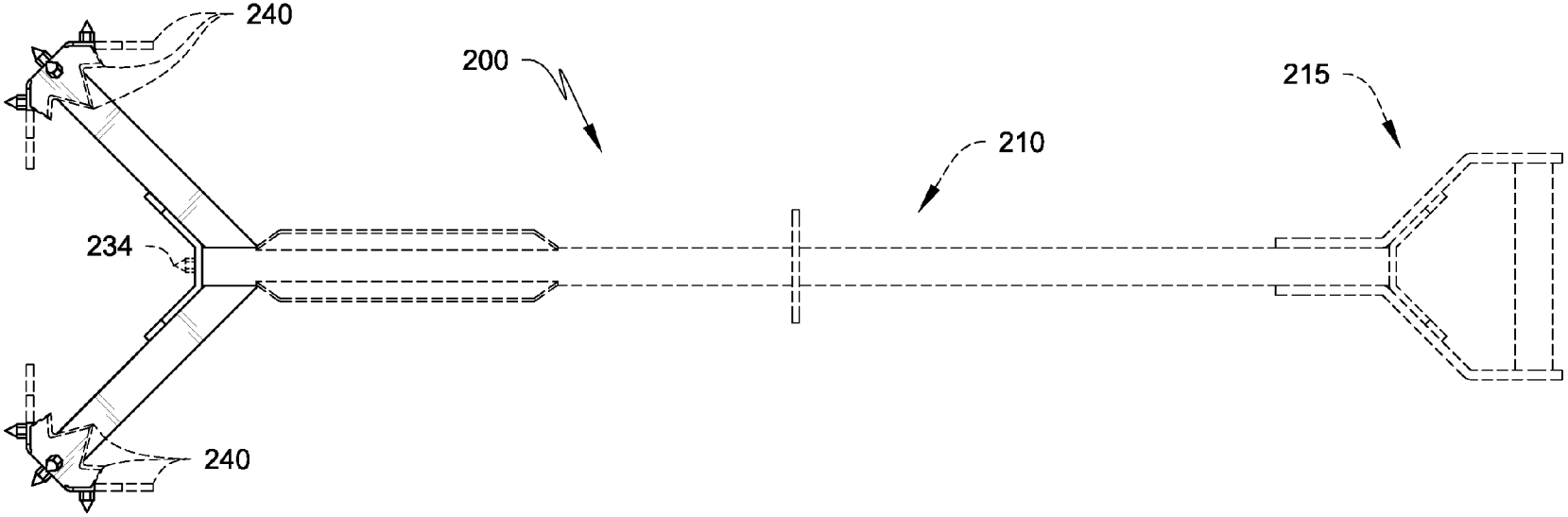
FIG. 11 is a top or bottom view of the tactical entry tool shown in FIG. 8.
Figure 12:
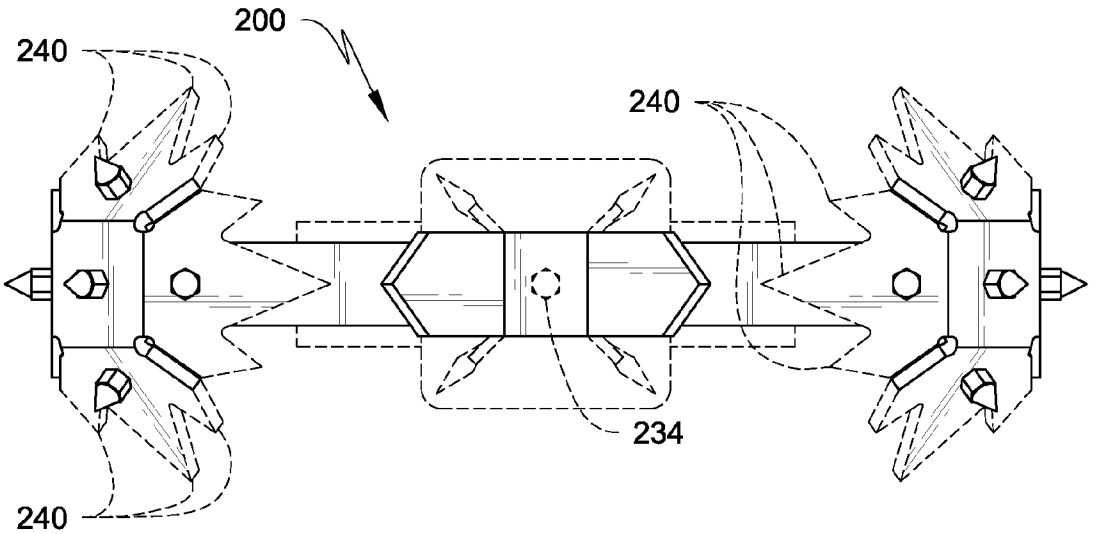
FIG. 12 is a front end view of the tactical entry tool shown in FIG. 8.
Figure 13:
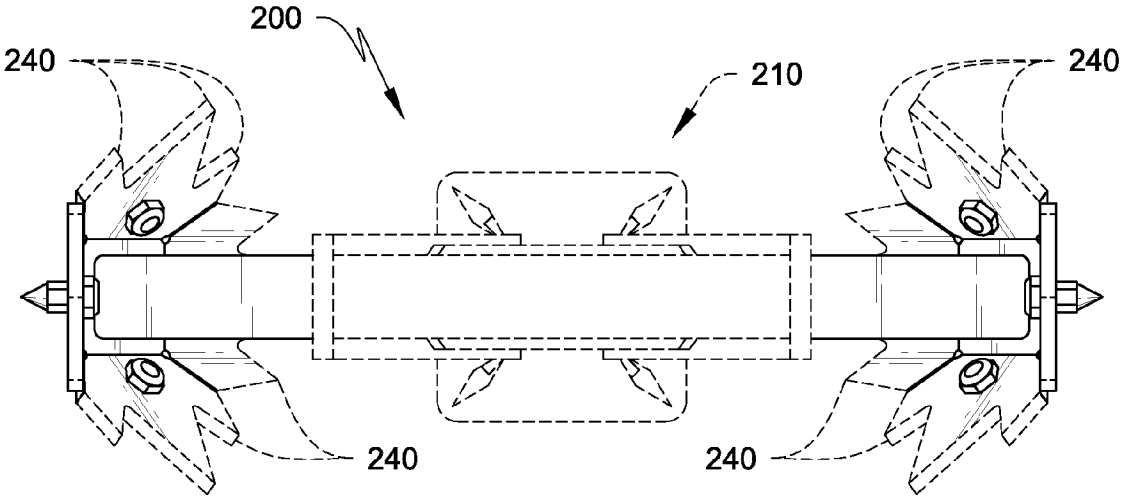
FIG. 13 is a rear end view of the tactical entry tool shown in FIG. 8.

FIGS. 8-13 provide multiple views of a tactical entry tool 200. Particularly, FIG. 8 is a front perspective view of the tactical entry tool 200. FIG. 9 is a rear perspective view of the tactical entry tool 200. FIG. 10 is a side view of the tactical entry tool 200. FIG. 11 is a top or bottom view of the tactical entry tool 200. FIG. 12 is a front end view of the tactical entry tool 200 and FIG. 13 is a rear end view of the tactical entry tool 200.

As shown in FIGS. 8-13, broken lines are used to show the breaker tip 234 on the hammer plate 225, the teeth 240, the shaft portion 210 and the handle portion 215 in order to indicate that these elements are not part of the tactical entry tool 200. The broken lines used to show these elements are merely provided to show optional elements that could be part of the tactical entry tool 200, as desired by the user. That is, in the embodiment shown in FIGS. 8-13, the breaker tip 234 on the hammer plate 225, the teeth 240, the shaft portion 210 and the handle portion 215 are not part of the tool 200, but are merely optional elements that can be added to the tool 200.

While the disclosed tactical entry tool has been described in conjunction with preferred embodiments, it will be obvious to one skilled in the art that other objects and refinements of the disclosed tool may be made within the purview and scope of the disclosure.

The disclosure, in its various aspects and disclosed forms, is well adapted to the attainment of the stated objects and advantages of others. The disclosed details are not to be taken as limitations on the claims.

The invention claimed is:

1. A tactical entry tool comprising:

a shaft; and a head portion attached to a first end of the shaft, the head portion including two heads, with each head including a head shaft extending from the shaft to form a 'Y' shaped structure and a breaker portion attached to the head shaft at an opposite end from which the head shaft is connected to the shaft, wherein the head portion is configured to create an entry point for an operator through a building structure.

2. The tactical entry tool of claim 1, further comprising a hammer plate attached to the shaft and the two heads at a base of the 'Y' shaped structure.

3. The tactical entry tool of claim 2, wherein a breaker tip is attached to the hammer plate.

4. The tactical entry tool of claim 1, wherein a plurality of rake fins is attached to the shaft near the first end of the shaft.

5. The tactical entry tool of claim 1, wherein a shield plate is attached to the shaft between the first end and a second end of the shaft and is configured to provide a shield for an operator's hand when holding the tactical entry tool.

6. The tactical entry tool of claim 1, wherein each of the breaker portions includes a middle plate and a plurality of peripheral plates attached to the middle plate and extending back towards the head shaft.

7. The tactical entry tool of claim 6, wherein a breaker tip is attached to each of the middle plate and the plurality of peripheral plates.

8. The tactical entry tool of claim 1, further comprising a handle portion attached to a second end of the shaft.

9. The tactical entry tool of claim 1, wherein a portion of the handle portion is coated with a resin configured to provide a firm grip for the operator.

10. The tactical entry tool of claim 1, wherein the head portion is removably attached to the shaft.

11. A head component for a tactical entry tool, the head component comprising:

two heads, with each head including a head shaft attached to a hammer plate near a first end of the head shaft, and a breaker portion attached to the head shaft at a second end of the head shaft opposite the first end of the head shaft;

the hammer plate including a middle portion and two side portions, each side portion extending away from opposite sides of the middle portion at an angle towards one of the breaker portions.

12. The head component of claim 11, wherein each breaker portion includes a plurality of teeth surrounding a perimeter of the breaker portion.

13. The head component of claim 11, wherein each breaker portion includes a plurality of breaker tips extending from the breaker portion.

14. The head component of claim 11, wherein a breaker tip is attached to the middle portion of the hammer plate.

15. The head component of claim 11, wherein each of the breaker portions includes a middle plate and a plurality of peripheral plates attached to the middle plate and extending back towards the head shaft.

16. The head component of claim 15, wherein a breaker tip is attached to each of the middle plate and the plurality of peripheral plates.

17. The head component of claim 11, wherein the head component is configured to removably attach to a shaft of a tactical entry tool.

18. A tactical entry tool comprising:

a shaft; and a head portion attached to a first end of the shaft, the head portion including two heads, with each head including a head shaft extending from the shaft to form a 'Y' shaped structure and a breaker portion attached to the head shaft at an opposite end from which the head shaft is connected to the shaft, wherein each breaker portion includes a plurality of teeth surrounding a perimeter of the breaker portion, and wherein the head portion is configured to create an entry point for an operator through a building structure.

19. A tactical entry tool comprising:

a shaft; and a head portion attached to a first end of the shaft, the head portion including two heads, with each head including a head shaft extending from the shaft to form a 'Y' shaped structure and a breaker portion attached to the head shaft at an opposite end from which the head shaft is connected to the shaft, wherein each breaker portion includes a plurality of breaker tips extending from the breaker portion, and wherein the head portion is configured to create an entry point for an operator through a building structure.

20. The tactical entry tool of claim 1, wherein each of the breaker portions is configured to create an entry point for an operator through a building structure.

21. The tactical entry tool of claim 1, wherein each of the breaker portions includes a middle plate and the head shaft is attached to the breaker portion at a surface of the middle plate facing the shaft.

22. The head component of claim 11, wherein a first side portion of the two side portions of the hammer plate extends along the head shaft of a first head of the two heads and a second side portion of the two side portions of the hammer plate extends along the head shaft of a second head of the two heads.

23. The head component of claim 11, wherein the hammer plate is configured to break through and remove debris from an entry point created in a building structure.

* * * * *